US010499692B2

(12) United States Patent
Braverman

(10) Patent No.: US 10,499,692 B2
(45) Date of Patent: Dec. 10, 2019

(54) BRASSIERE

(71) Applicant: Laurie Braverman, New York, NY (US)

(72) Inventor: Laurie Braverman, New York, NY (US)

( * ) Notice: Subject to any disclaimer, the term of this patent is extended or adjusted under 35 U.S.C. 154(b) by 835 days.

(21) Appl. No.: 13/839,566

(22) Filed: Mar. 15, 2013

(65) Prior Publication Data

US 2014/0154947 A1 Jun. 5, 2014

Related U.S. Application Data

(60) Provisional application No. 61/733,192, filed on Dec. 4, 2012.

(51) Int. Cl.
*A41C 3/10* (2006.01)

(52) U.S. Cl.
CPC ..... *A41C 3/10* (2013.01)

(58) Field of Classification Search
CPC ..... A41C 3/142; A41C 3/144; A41C 3/146; A41C 3/148; A41C 3/14; A41C 3/0092; A41C 3/005
USPC ..... 450/54, 55, 56, 57
See application file for complete search history.

(56) References Cited

U.S. PATENT DOCUMENTS 2,052,707 A 9/1936 Haimoff
2,342,076 A * 2/1944 Herbener ..... A41C 3/144 450/56
2,567,732 A 9/1951 Rosenthal
2,632,169 A * 3/1953 Silvani ..... A41C 3/10 450/55
2,673,981 A 4/1954 Popp
2,715,225 A * 8/1955 Gould ..... A41C 3/02 450/58
2,719,975 A * 10/1955 Rosenthal ..... A41C 3/00 2/73

(Continued)

FOREIGN PATENT DOCUMENTS

RU 98734 10/2010
WO WO 2010/062164 A1 * 6/2010 ..... A41C 3/00

OTHER PUBLICATIONS

Search report from P.C.T., dated Mar. 13, 2014.

(Continued)

*Primary Examiner* — Gloria M Hale
(74) *Attorney, Agent, or Firm* — Greenblum & Bernstein, P.L.C.

(57) ABSTRACT

A brassiere includes a first wing and a second wing, a closure including a first closure portion on a first end of the first wing, and a second closure portion on a first end of the second wing; a pair of cups including a first cup connected to the second end of the first wing, and a second cup connected to the second end of the second wing; each cup including an inner contour shaped with an inner apex matching a breast to receive the breast in a natural bust point position, and an outer contour having a size larger than the inner contour and shaped with an outer apex spaced medially from the inner apex, and filling material between the inner contour and the outer contour; a gore connected between the first cup and the second cup; and a pair of straps including a first strap connected to the first cup and the first wing, and a second strap connected to the second cup and the second wing.

13 Claims, 11 Drawing Sheets

(56) References Cited

U.S. PATENT DOCUMENTS 2,728,079 A 12/1955 Williams
2,734,193 A 2/1956 Croxall
3,221,747 A 12/1965 Blair
3,814,107 A * 6/1974 Greenblatt ..... A41C 3/10 450/56
3,834,397 A * 9/1974 Birch ..... A41C 3/10 450/56
4,519,137 A 5/1985 O'Boyle et al.
4,767,377 A * 8/1988 Falla ..... A41C 3/10 450/52
5,098,330 A * 3/1992 Greenberg ..... A41C 3/10 450/31
5,458,635 A * 10/1995 Berman ..... A61F 2/52 623/7
5,492,501 A * 2/1996 Brown ..... A41C 3/12 2/73
5,607,473 A * 3/1997 Weber-Unger ..... A61F 2/52 623/8
5,873,768 A * 2/1999 Fleischman-Ament ..... A41C 3/0057 2/73
6,083,080 A * 7/2000 Lawson ..... A41C 3/0057 450/39
6,089,953 A * 7/2000 Chen ..... A41C 3/0042 2/1
6,101,630 A * 8/2000 Lee ..... A41C 3/0028 2/57
6,132,288 A * 10/2000 Aerts ..... A41C 3/144 450/38
6,224,458 B1 * 5/2001 Chen ..... A41C 3/10 450/38
6,241,575 B1 * 6/2001 Shailer ..... A41C 3/105 2/69
6,272,761 B1 * 8/2001 Pechter ..... A41H 1/02 33/17 R
6,296,545 B1 * 10/2001 Chen ..... A41C 3/0092 2/267
6,425,800 B1 * 7/2002 Huang ..... A41C 3/0007 450/41
6,431,945 B1 * 8/2002 Stephens ..... A41C 3/10 450/37
6,679,912 B2 * 1/2004 Stelter ..... A61F 2/52 623/7
6,685,534 B2 * 2/2004 Mitchell ..... A41C 3/0007 450/74
6,746,306 B2 6/2004 Brothers
6,811,463 B2 * 11/2004 Martz ..... A41C 3/0057 2/267
6,857,932 B2 * 2/2005 Chen ..... A41C 3/146 2/267
6,918,812 B2 * 7/2005 Giese ..... A41C 3/0021 450/65
7,033,244 B1 * 4/2006 Barton ..... A41C 3/04 450/36
7,192,332 B2 * 3/2007 Liu ..... A41C 3/0014 450/39
7,252,574 B2 * 8/2007 Chen ..... A41C 3/146 450/38
7,309,275 B1 * 12/2007 Morales ..... A41C 3/02 450/38
7,442,110 B2 * 10/2008 Gaudet ..... A41C 3/0057 450/39
7,618,304 B2 * 11/2009 Chen ..... A41C 3/146 450/36
7,871,305 B2 1/2011 Cohen
8,113,908 B1 * 2/2012 Modena ..... A41C 3/0007 450/39
8,123,589 B2 2/2012 Chapman
8,216,021 B1 * 7/2012 MacKinnon ..... A41C 3/10 450/54
8,388,406 B2 * 3/2013 Liu ..... A41C 3/10 450/39
8,506,348 B2 * 8/2013 Hu ..... A41C 3/10 450/39
8,956,199 B2 * 2/2015 Liu ..... A41C 3/146 450/38
9,011,199 B2 * 4/2015 Yuasa ..... A41C 3/10 450/53
2003/0232571 A1 * 12/2003 Weinerth ..... A41C 3/10 450/41
2004/0259467 A1 * 12/2004 Brothers ..... A41C 3/0007 450/54
2006/0252344 A1 * 11/2006 Jian ..... A41C 3/10 450/54
2007/0298682 A1 * 12/2007 Liu ..... A41C 3/0014 450/39
2008/0305714 A1 * 12/2008 Sobah-Wilhelm ... A41C 3/0028 450/38
2009/0233524 A1 * 9/2009 Cohen ..... A41C 3/0028 450/56
2009/0247047 A1 * 10/2009 Avalos-Dessner ..... A41C 3/10 450/52
2009/0311943 A1 * 12/2009 Mone ..... A41C 1/14 450/38
2010/0015886 A1 * 1/2010 Waitz ..... A41C 3/10 450/39
2010/0022164 A1 * 1/2010 Taylor ..... A41C 3/10 450/41
2010/0041313 A1 * 2/2010 Castellano ..... A41C 3/144 450/39
2010/0048098 A1 * 2/2010 Rosario ..... A41C 3/0035 450/57
2010/0273395 A1 * 10/2010 Castellano ..... A41C 3/144 450/39
2010/0317256 A1 * 12/2010 Zhang ..... A41C 5/005 450/38
2011/0111674 A1 * 5/2011 Padula ..... A41C 5/005 450/38
2011/0287691 A1 * 11/2011 Hu ..... A41C 3/10 450/56
2012/0045966 A1 * 2/2012 Zhang ..... A41C 3/144 450/57
2012/0135667 A1 * 5/2012 Chan ..... A41C 3/0092 450/58
2012/0156961 A1 * 6/2012 Mayer ..... A41C 3/144 450/55
2012/0184180 A1 * 7/2012 Hu ..... A41C 3/10 450/55
2012/0259412 A1 * 10/2012 Reusch ..... A61F 2/52 623/8
2013/0109276 A1 * 5/2013 Sporn ..... A41C 3/10 450/57
2014/0154947 A1 * 6/2014 Braverman ..... A41C 3/10 450/41
2016/0029706 A1 * 2/2016 Braverman ..... A41C 3/0092 450/55
2016/0165964 A1 * 6/2016 West ..... A41C 3/0007 450/53
2017/0156413 A1 * 6/2017 Braverman ..... A41C 3/10

OTHER PUBLICATIONS

"Her Room" webpage, Jun. 28, 2012.
"Brassiere" Wikipedia webpage, Sep. 30, 2011.
"Brassiere Measurement" Wikipedia webpage, May 13, 2011.
"Brassiere Measurement" Wikipedia webpage, Mar. 2013.
"The Bra Book", pp. 24-25, 46-47, 49, 50, 55, 73-75, 189-192, 197-198, Nov. 2012.
"Eve's Apples" webpage, Jun. 16, 2012.
"Lula Lu" webpage, Aug. 5, 2008.
"Beauty Lies Beneath" webpage, Mar. 2013.
"How to Make a Bra" webpage, Jul. 3, 2012.
"Biofit Uplift, See How It Works", Sep. 2011.
"The Bra-makers Manual" vol. 1, Beverly Johnson, webpage, Jun. 28, 2012.
"The Bra-makers Manual" vol. 2, Beverly Johnson, webpage, Jun. 28, 2012.

(56) References Cited

OTHER PUBLICATIONS

"Bare necessities" webpage, Jun. 28, 2012.
"Book studies the history, underlying facts of bras", Chicago Tribune webpage, Jul. 26, 2011.
"Bustpoint Spacing", Her Room Website, Jun. 2012.
"Breast Separation It Matters", Tomina Blog, Oct. 2012.
"Classify Your Breasts", Tomina Blog, Mar. 2013.
"How to Tell If Your Bra Fits", About.com, Oct. 2012.
"6 Ways to Tell If Your Bra Fits", About.com, Oct. 2012.
"Partial Coverage Bra Fitting", Oct. 2012.
"Boosaurus Bra Fitting", Oct. 2012.
"Breast Shapes Invest in Your Chest", A Lingerie Blog, Oct. 31, 2012.
"A Few Words About Breasts" by Nora Ephron, Esquire, Jun. 2012.
"Mail on Line How a Bowl of Warm Water Can Help You Buy a Bra That Fits Better", Jul. 2012.
"Cleavage Enhancement", Wikipedia, Oct. 26, 2011.
"List of Brassiere Designs", Oct. 26, 2011.
"Eves Apple Custom Bra Fit Consultation", Jun. 2012.
"The Optometrist Attic Fitting and Measuring", Jul. 16, 2012.
"Bravo", New York Post, Jul. 25, 1999.
"What's worse than badly fitting shoes?", New York Times, Sep. 2, 2010.
"To sell lingerie, inhibitions, and much more, are falling", New York Times, Nov. 6, 2003.
"Dreaming of bras for the modern woman", New York Times, Nov. 28, 2005.
"As a gauge of social change, behold: the breast", New York Times, Nov. 28, 2005.
"Where minimal assets are a plus", New York Times, Sep. 2, 2010.
"Little Woman", UK website, Jun. 22, 2013.
EPO Extended Search Report, dated Apr. 22, 2016.
EPO Office Action, dated Jan. 13, 2017.

* cited by examiner

INSIDE VIEW

OUTSIDE VIEW

OUTSIDE VIEW

INSIDE VIEW

OUTSIDE VIEW

INSIDE VIEW

OUTSIDE VIEW

INSIDE VIEW

BRASSIERE

CROSS-REFERENCE TO RELATED APPLICATIONS

The instant application claims the benefit of priority of U.S. provisional application No. 61/733,192, filed Dec. 4, 2012, the disclosure of which is hereby expressly incorporated by reference hereto in its entirety.

BACKGROUND OF THE INVENTION

1. Field of the Invention

The invention relates to the field of brassieres, particularly to the field of brassieres for smaller sizes/immovable breasts.

2. Description of Related Art

Generally, brassieres for smaller sizes/immovable breasts merely scale down from the larger sizes, without taking into account the basic differences between smaller size and immovable breasts and larger size pendulous breasts. Smaller size breasts are immovable.

In this regard, smaller/immovable size breasts do not project downwardly and outwardly, as do larger sized breasts. Smaller/immovable breasts do not need to be supported in the same manner since the smaller/immovable breasts are not pendulous as are the larger natural breasts. Current bra cups project forward, in an attempt to push the breast tissue up, in a forward direction, and towards each other to create cleavage.

By scaling from a C cup to a smaller size cup, as is presently done in the industry, the volume is presumed to be less and the boundary is presumed to be smaller.

In the prior art brassieres, the cups are positioned in the wrong place and do not function properly. In particular, the cups are too close together, and the gore cannot touch the body.

U.S. Pat. No. 4,519,137 to O'Boyle et al. discloses a brassiere. The patent describes the problems small busted women have with industry bras and grading. In the Background of the invention, O'Boyle et al. describes the problems with brassiere sizing in the art. In particular, O'Boyle et al. teaches that brassieres are produced in standard sizes based upon the around the body dimension of the wearer, and a cup volume designation. In the United States, the body measurement is stated in inches and is divided into two inch increments e.g. 30, 32, 34, 36, 38. Cup volume is referred to by the letters of the alphabet beginning at AA and progressing to A, B, C, D and DD with AA being the smallest volume size. When a brassiere style is in development, it is initially fitted to a particular size. The size customarily used is size 34B, because it is considered to be representative of the most commonly worn size. A master pattern for each of the major brassiere components is developed from this size 34B prototype. This master pattern is then used in making a pattern for other sizes, which is called grading. The accepted industry practice is to grade from the size 34B to smaller volume capacity cup sizes (size 34A) to reduce on a proportional basis both the depth of the breast receiving cup and the entire perimeter of the breast receiving cup. By proportionally reducing the entire circumferential perimeter of the cup, the remaining body encircling portions are required to be elongated so that the around the body fit could be achieved. The reduction in the circumference of the cup perimeter on a proportional basis also results in the lower edge of the cup being positioned upon the chest wall in the size 34A brassiere differently than in a size 34B brassiere of like styling. While dissatisfaction with fit is generally known for A and AA cup wearers, only limited success has been achieved in correcting the problem.

To determine sizing, it is generally accepted in the industry to determine size as a function of the diaphragm dimension, the around the body chest dimension and the bust dimension. The accepted industry measurements include two basic around the body measurements, the diaphragm measurement which determines the enumerated brassiere size (which is taken around the body below the breasts), and the body chest dimension which is taken around the body along the high points (areola) of the breasts. In general, cup volume is determined by computing the bust size based upon the difference in measurement between the chest measurement and the bust measurement. For example, the following may be used: if the bust is up to ½ inch larger then than the chest, the cup size is AA; if the bust is over ½ inch to 1½ inches larger than the chest, the cup size is A; and if the bust is over 1½ inches and up to 2½ inches larger than the chest, the cup size is B.

Accordingly, the prior art patents still exhibit numerous disadvantages and problems for providing a correct fitting and correct looking brassiere for the smaller sizes.

The invention recognizes the deficiencies in the prior art practices and grading from size B cup to a size A cup was inappropriate. Proportional reduction resulted in a brassiere in which the cups and sides were not optionally positioned on the body. As a result of the cup perimeter being reduced in all dimensions a longer body encircling member is required to compensate for the around the body length not taken up by the breast receiving cups. This mispositions the cups and side panels. For example, the side panel instead of being positioned along the turn of the body (that is where the rib cage curves toward the back of the anatomy) extends along the front of the body.

Further, a problem with industry grading is that it assumes by grading from larger sizes that rib cage circumference decreases with less tissue volume. This is not true. Because of cross grading the industry assumes a larger cup size for a larger rib cage circumference. For example, for a rib cage circumference of 36 inches, the industry assumes a larger cup size than for a rib cage circumference of 34 inches. This is not necessarily correct. The solution for this patent is a grading system to keep the lower measurement of the cup on the band the same as for larger sizes. The patent though still reduces the cup according to standard grade rules for the rest of the cup. Once again, the prior art incorrectly assumes that if there is less volume there must be a smaller cup diameter.

U.S. Pat. No. 6,746,306 to Brothers describes a postoperative bilateral augmentation brassiere. The patent describes the problem of the center front connector between the cups not being wide enough for proper fit. The Brothers patent discusses the problem of manipulating a relatively smaller base diameter on the chest wall, and describes how industry bras don't fit properly and therefore don't work according to their engineering. U.S. Pat. No. 6,746,306 to Brothers discloses a postoperative bilateral augmentation mammoplasty brassiere. The patent describes the natural shape of a woman's breast prior to a bilateral augmentation mammoplasty as having a "teardrop" profile. The shape of the inframammary (under the breast) fold of the natural breast has the shape of a flattened semicircle, which flattened semicircle fold is representative of the shape of the similarly shaped underwires used in constructing brassieres. The shape of the cups of conventional brassieres are typically conical. A conically shaped brassiere cup does not comfortably accommodate the hemispherical shape of the augmented breast formed by the underlying breast implant. Typically, the augmented breast does not fill out the "tip" of the cone, nor is the bust point supported. Most known types of brassieres do not provide for the augmented breast shape and related chest wall relationships or the additional support required by a woman with augmented breasts. The typical augmented breast has a somewhat hemispherical shape and a convex downslope extending from below the clavicle to the nipple, and a relatively smaller base diameter on the chest wall when compared to a natural breast of equal volume. This is the reason many women with augmented breasts have a wide cleavage or medial distance between the breasts. The bust point, or nipple also has a greater anterior projection than that of a natural breast, and the inframammary fold is now a true semicircle in accordance with the circular shape of the round breast implant. In conventionally constructed brassieres, the center front connector between the cups also is not wide enough for proper fit with augmented breasts. The connector typically is raised off the chest wall thus diminishing the brassieres cantilevered support system. The brassiere cups and breasts are thus forced medially toward center front. Consequently, the cups and underwires are distorted, the cleavage is deepened and the brassiere appears unattractive and too tight. There should be no space between the center front and the chest wall in a properly fitted, comfortable and attractive brassiere that offers the full benefit of a cantilevered support system. What is needed is a center front connector that eliminates the above mentioned problems and ensures proper fit, comfort and support for the breasts. The Brothers patent solves these problems for the woman with augmented breasts by changing the shape of the underwire, formed as a slightly lengthened true semicircle with slight center front outward deflection and lateral outward deflection, changing the shape of the cup in that it has an arcuate shape in both the vertical and horizontal directions for creating a "spherical" cup, and changing the defined width of the center front connector, and its relationship to the center front tips of the underwires of the brassiere allowing for better fit, comfort, appearance and support.

The current assumption is that all breasts should be brought forward and together, therefore the cups should be brought in closer together. They are taking the smaller/immovable breast tissue from the width and trying to put it in the front.

Smaller size breasts and augmented breasts, in the same vein, are relatively immovable.

Additionally, in the prior art, the brassieres attempt to move immovable breast tissue towards the center of the chest and to put the tissue into cups that have an incorrect position and projection, due to grading from larger sizes that have a position and projection that doesn't work for smaller/immovable breasts. The industry also assumes by scaling from a larger size cup the smaller/immovable breasts require smaller cup diameters and wires. This also is not correct.

When scaling and grading bras from larger sizes, as a result of the grading, the industry brings smaller cups closer together (reducing the gore spacing) because that is the philosophy for larger breasts. Bringing cups closer together for the smaller/immovable breast places the underwire into the bust on the side, resulting in the underwire digging into the breast tissue. This reduced spacing also doesn't allow the gore to sit flat on the chest, which doesn't allow the engineering to work properly. This doesn't work for smaller/immovable breasts that are immovable.

In the prior art, the underwire is in the wrong place and has too small of a diameter.

In the industry, the "bustpoint" is defined as the location of the cup in the cradle. When a manufacturer grades his pattern to create different sizes for a bra style he moves the bust point slightly wider with each cup size increase. According to the website, "Her Room", (B) cup bust points are ½" further apart than (A) cups. Bust points get ¼" farther apart between (B) and (C) and (D) cups and ⅛" farther apart with larger cups. Also in the industry, "band size" is the ribcage measurement. "Cup size" is defined as breast projection. It is a measurement of how far the breasts project from the chest wall. Each cup size denotes a 1" increase in your body's circumference around your bustline.

According to Brassiere Measurement as defined on the website Wikipedia, the term "cup" was not used to describe bras until 1916, and manufacturers relied on stretchable cups to accommodate different sized breasts. In October 1932, the SH Camp and Company correlated the size and pendulousness of a woman's breast to letters of the alphabet A through D.

Accordingly, the (A) and (B) cups and the sizing for the (A) and (B) cups were developed for pendulous breasts, and have been designed as such ever since.

Industry designs these bras to contain the weight and engineer the product to work with this weight and movement. An A size bust has none of these features. An A size bust is basically 1" larger than the rib cage and cannot be manipulated the way the larger sizes can. An A cup breast also does not need the same support as the larger sizes, yet the cups produced are scaled down from a mass and weight bearing philosophy.

When the industry does consider the A customer the solution is either no cup at all, a padded cup which is a version of a push-up, a gel insert or a foam liner. The push up or cookie models are designed to add volume from under the bust for lift or uses slanted cups with padding to create cleavage. For the small A cup these solutions are uncomfortable and ineffective because they don't take into account the problems of the limited mass of the small bust or the location of the bust on the body. They are a solution based on the industry solution for a larger bust to create support, lift and cleavage. Using the C cup design and scaling it down for the A bust places the brassiere in the wrong place on the body. The engineering for a larger bust design does not scale properly for the smaller bust.

Standards for bra sizing in the United States and the world are as described in the following text and charts.

Bra Standards (The Bra Book): Figuring out proper cup size is not easy. It is calculated in relation to band size. The size of an A cup, i.e., the volume an A cup holds, changes depending on the band size. An A cup on a 32 band is not the same as an A cup on a 34 band, and so on. Just because a B is thought to be smaller than a C does not mean it actually is. A B cup is just smaller than a C on the same band size. The snugger band size decreases the width and depth of the cup which means the 34C, while smaller than the 36C, actually holds the same volume of breast tissue as the 36B. A 38A compared to a 34A, the cup will be obviously bigger. But if you compare a 38A with a 34D, the cups will be much closer in size.

Step 1: Band Size: First wrap the tape measure around the ribcage just below the bust and take the measurement. Since bra band sizes are even numbers, round up to the nearest even number. For example if the measure is 31 inches, round up to 32. The most common way of fitting advises adding 4 inches to this number. Some fitters advise to add only 2 inches to their rounded up ribcage measurement. So if the measure is 30 inches, the wearer is likely a 32 band. Some fitting methods combine these two, advising that if the ribcage measurement is 32 or below, then add 4 inches and if it's 34 or above add only 2 inches. Still other fitters will advise not to add any additional inches at all, which does work for some women.

Step 2: Cup Size: Wrap the tape measure around the fullest part of the bust. Then subtract the band size from this number and use the difference in inches to calculate the cup size using the chart. For example, if the bust measurement is an inch larger than the band size, the cup size will most likely be an A. If the bust measurement is two inches larger than the band size, the cup size will most likely be a B.

CHART 1

| Difference: Bust measurement Minus band size | U.S. Cup Size |
|---|---|
| Less than 1" | AA |
| 1" | A |
| 2" | B |
| 3" | C |
| 4" | D |
| 5" | DD/E |
| 6" | DDD/F |
| 7" | G |
| 7.5" | GG |
| 8" | G, H |
| 9" | H, I |
| 10" | H, I, J |
| 11" | HH |
| 11.5"-13" | I |
| 13"-15.5" | J |
| 15.5"-17" | K, JJ |

CHART 2

| International Sizing: Bra-Band Sizing | | | | | |
|---|---|---|---|---|---|
| USA | UK | EURO | French | Italian | Australian |
| 28 | 28 | | | | |
| 30 | 30 | — | | | |
| 32 | 32 | 70 | 85 | 1 | 10 |
| 34 | 34 | 75 | 90 | 2 | 12 |
| 36 | 36 | 80 | 95 | 3 | 14 |
| 38 | 38 | 85 | 100 | 4 | 16 |
| 40 | 40 | 90 | 105 | 5 | 18 |
| 42 | 42 | | | | |
| 44 | 44 | | | | |
| 46 | 46 | | | | |
| 48 | 48 | | | | |
| 50 | 50 | | | | |
| 52 | 52 | | | | |
| 54 | 54 | | | | |
| 56 | 56 | | | | |

CHART 3

| International Sizing: Bra-Cup Sizing | | | | | |
|---|---|---|---|---|---|
| USA | UK | EURO | French | Italian | Australian |
| AA | AA | AA | AA | | |
| A | A | A | A | A | A |
| B | B | B | B | B or none | B |
| C | C | C | C | C | C |
| D | D | D | D | D | D |
| DD/E | DD | E | E | DD | DD |
| DDD/F | E | F | F | E | E |
| G | FF | | | F | F |
| H | FF | | | | FF |
| I | G | | | | G |

CHART 3-continued

| International Sizing: Bra-Cup Sizing | | | | | |
|---|---|---|---|---|---|
| USA | UK | EURO | French | Italian | Australian |
| J | GG | | | | GG |
| K | H | | | | HH |
| L | HH | | | | |
| M | J | | | | J |
| N | JJ | | | | JJ |

According to Wikipedia, most bras are designed to be form fitting and to lift the breasts off the chest wall if they sag and to restrain their movement. Bra designers and manufacturers originally produced bras that were purely functional and gradually added elements to improve the design, but they have now largely shifted from functionality to fashion. Manufacturers' standards and sizes vary widely, making it difficult for women to find a bra that fits. Bra measurement procedures conflict with one another. Even professional bra fitters disagree on the correct size for the same woman. Women's breasts vary widely in size and shape; most are asymmetric to a degree and can change from month to month depending on the menstrual cycle, pregnancy, or weight gain or loss. As a result, from 75-80% of women wear the incorrect bras size.

A bra usually consists of a cup for each breast, a center panel (the gore), a band running around the torso under the bust, and shoulder straps.

There are different sizing systems in different countries. Most use the chest circumference measurement system and cup sizes A, B, C, etc., but there as some significant differences. Most bras available usually come in 36 sizes, but bra labeling systems used around the world are at time misleading and confusing. Cup and band sizes vary around the world. For example, must women assume that a B cup on a 34 band is the same size as a B cup on a 36 band. In fact, bra cup size is relative to the band size, as the actual volume of a woman's breast changes with the dimension of her chest. In countries that have adopted the European dress size standard, the torso is measured in centimeters and rounded to the nearest multiple of 5 cm.

Bra designers liken designing a bra to building a bridge because similar forces are at work. As a bridge is affected by gravity and horizontal forces, forces affecting a bra's design include gravity and sometimes tangential forces created when a woman runs or turns her body.

The "pencil test", developed by Ann Landers, has been promoted as a criterion to determine whether a girl should start wearing a bra. A pencil is placed under the breast, and if it stays in place by itself, then wearing a bra is recommended; if it falls to the ground, it is not. This is illustrative of the pendulousness of larger breasts.

Many problems, including health problems, are associated with poorly fitting bras. Finding the correct fit can be very difficult for many women. Studies also show that the current system of bra sizing is quite inadequate. Larger breasted women tend to wear bras that are too small, and smaller breasted women tend to wear bras that are too big.

It is commonly accepted that sagging occurs because a breast's normal anatomical support is inadequate, especially in women with larger breasts. The bra is worn to provide artificial lift, based on the presumption that the breasts cannot support themselves. Frequently, A cup women are more comfortable without a bra than with a bra.

According to Eve's Apples, the traditional bra measuring system of adding 4-5 inches on the band doesn't work on small busted women, leaving most without an accurate bra size and some without a size at all. The number one fix for women in the wrong bra size is to go up a cup size and down a band size. The same is true for small busted women. Due to the inaccurate results in traditional bra measuring and the variety of small bust shapes, they have altered the traditional bra measurement system to best fit small busts.

The Individual Breast Measurement system helps women who are in between sizes or have wide set breasts. It will tell a woman if she needs a larger cup size due to breast shape. This is a system in which each breast is individually measured from the breast bone across the breast and to the place where the breast tissue ends on the side of the body.

A woman's breast tissue affects the way a bra fits. There are three types of breast tissue including shallow, medium, and hill. There are also differences in breast placement including narrow breasts, centered breasts, and wide set breasts. All of the differences affect the fit of the bra. There are myths regarding bras for the small breasted woman that women with small breasts don't need a bra, and that women with small breasts must wear an A cup. These are not true.

According to Her Room, when selecting a bra, it is important to know that a cup size on one band size is not equal to the same cup size on another band size. When a manufacturer grades his patterns to create different sizes for a bra style, he moves the bust points slightly wider with each cup size increase. B cup bust points are ½" farther apart than A cups. Bust points get ¼" farther apart between B, C, and D cups, and ⅛" farther apart with larger cup sizes.

An element of the proper fitting bra is the center panel, or gore. It is best if the center panel between the cups sits firmly against your chest.

For underwire bras, each band size has a pre-determined breast diameter built into it in the form of an underwire. Changing your band size can change the underwire diameter. It is also a fact that the same size underwire is used in different cup sizes—the underwire in a 36C is the same underwire used in a 34 D and a 38B cup size. Thus, when you go up a band size and down a cup size, you will have the same fitting cup diameter (the same wire will be used) but a larger band. The diameter increase between standard underwire sizes is approximately ⅜". A standard underwire's length increase between sizes is approximately ⅝".

According to Lula Lu, as the band size goes up, so does the cup size due to how bra cups are graded. For example, the 36AA cup is larger than a 34AA cup and a 34AA cup is larger than a 32AA cup. Additionally, manufacturers normally use a B or C cup for their bra designs and an A cup is usually scaled down from either the B or C cup used in the designs. Thus, the A cup may not be a true A cup and can result in a poor fit for smaller cup women.

According to How To Make a Bra, by Mark Garbarczyk, when a designer produces a new bra, the prototype is made to a core size. This prototype is then "graded" (enlarged or reduced) to produce the other sizes. For size/band grading, the standard step increase in band size is 2", which takes a 34B to a 36A, for example. The underband will increase by 2", a quarter of that increase must be placed in each half cradle and wing. For cup grading, to get from 34B to 34C, for example, the underband length remains the same, the cradle must increase to provide the larger cup size, but the wing must get smaller to maintain the underband length, and the cup section is graded one size larger. The grading principles used currently in the industry are as follows. Cup Grading: to increase the cup volume, the cradle of the bra must also increase to accommodate the increase in cup size and the wing must be reduced to maintain the band size. Band Grading: to increase the size of the band, but maintain the sup/cradle size, combined with cup grading. Cross Grading: to use the cups and cradle of one size as the cups and cradle of another size bra.

According to Wikipedia, bra sizes consisting of a number indicating the band size and a letter indicating the cup size became popular by the 1940's. The shape, size, symmetry, and spacing of women's breasts vary, the breasts may have been augmented, the breasts may be tubular in shape, or may sag. Manufacturing standards and sizes vary. All of which contribute to poorly fitting bras.

U.S. Pat. No. 8,123,589 to Chapman discloses a bra size grading system. In the Summary section, Chapman addresses the problems with industry grading. In the current industry, grading assumes that everything gets reduced with smaller cup sizes. This is incorrect, and by doing so, does not put the cup in the correct position on the body.

The website Beauty Lies Beneath includes the following European size chart:

| Cm 2 | IT | EU | FR | UK | US | CUP B | CUP C |
|---|---|---|---|---|---|---|---|
| 63-67 | 1 | 65 | 80 | 30 | xs | 79-81 | 81-83 |
| 68-72 | 2 | 70 | 85 | 32 | s | 84-86 | 86-8 |
| 73-77 | 3 | 75 | 90 | 34 | m | 89-91 | 90-93 |

Bra Band Size:

| USA | Italy |
|---|---|
| 30 | 1 |
| 32 | 2 |
| 34 | 3 |
| 36 | 4 |
| 38 | 5 |

The above European chart shows that if you measure at 34", the B cup is 89-91 and the C cup is 90-93.

The website called 85B includes an international bra size calculator. It measures:

(1) "below the breast" band size;

(2) "around the breasts and back" (bust size); and (3) "above the breasts" (above bust size).

International Variance and Equivalent Sizes:

It is common for manufacturers of any country to attach size labels to their garments which quote their equivalent sizes in a number of different countries. Unfortunately, these are often inaccurate. An example may help explain the problem. A bra made in Europe which corresponds to the European size 75B, for instance, will most probably be labeled as 34B (USA) and 34B (UK) and, as the method of calculation for cup size differ in these countries, it is possible that the physical size of the cup may differ also. In some cases the band size may also differ.

In order to counteract this effect, the 85B Bra size calculator calculates the result for each national standard separately using the correct method for each.

Entering these measurements in their respective fields of the 85B Bra size calculator:

1. Band size: 30
2. Bust size: 36
3. Above bust: 34

Calculated, the US and UK sizes are shown as 34B but the European size is 75C and not 75B, as may have been expected. The calculator converted the inch measurements to centimeters and then calculated the European size according to standard EN 13402. At the same time it calculated the US sizing using the standard method and the UK size with the method used in the UK.

European clothes sizes follow the European Standard EN13402. The 85B Bra six calculator adheres to this standard.

SUMMARY OF THE INVENTION

The present invention is directed to an undergarment, which addresses the problems existing in the prior art, discussed above.

In order to solve the disadvantages and shortcomings in the prior art, the present invention keeps everything the same on the outside as a 34B for a 34A, except the projection. The present invention cannot be graded from a standard. A 34B diameter is used on the outside of the cup and, in order to do that, a fill is created inside to replace the breast tissue of a 34B that is missing to hold up the larger diameter of the cup.

The present invention provides the correct fit for the smaller sizes by positioning the cups wider apart to accommodate the wider spread and immovable breast tissue.

BRIEF DESCRIPTION OF THE DRAWINGS

The above and other objects, features and advantages of the present invention will be made apparent from the following description of the preferred embodiments, given as nonlimiting examples, with reference to the accompanying drawings in which.

DETAILED DESCRIPTION OF THE INVENTION

The present invention is directed to an undergarment, and more particularly to a brassiere.

Figure 1:
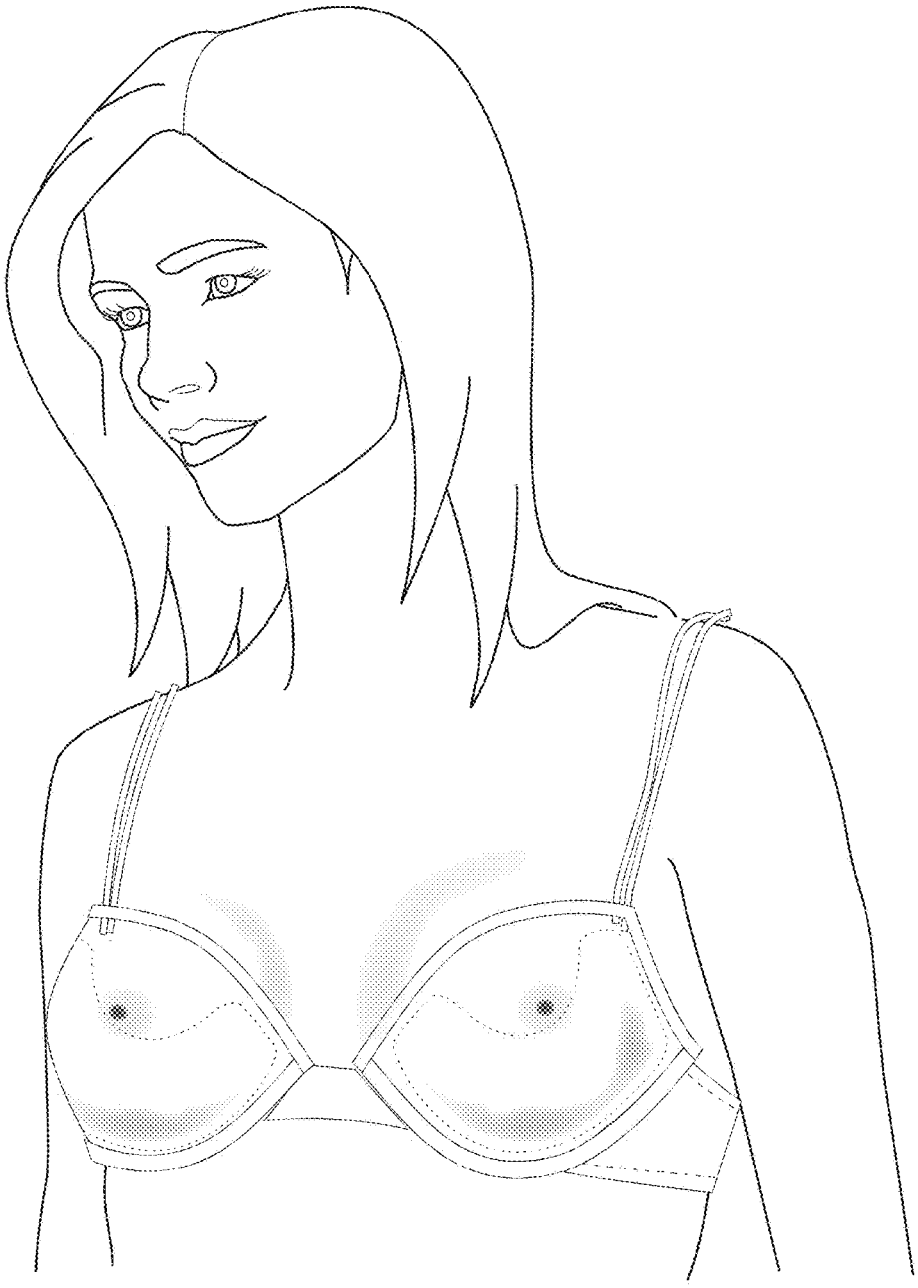
FIG. 1 is a front perspective view of a brassiere according to an embodiment of the present invention, showing an inside view of the brassiere.
Figure 2:
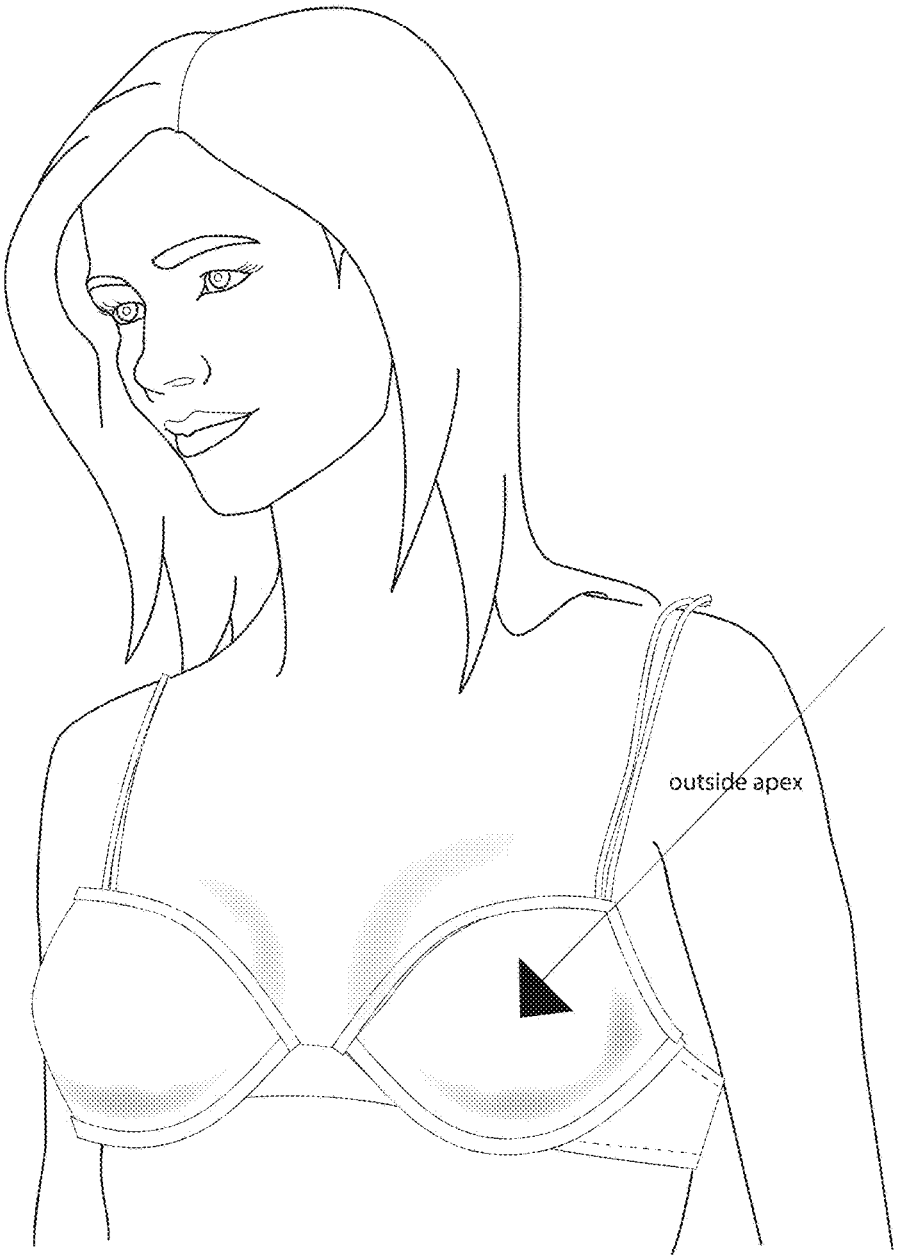
FIG. 2 is a front perspective view of a brassiere according to an embodiment of the present invention, showing an outside view of the brassiere.
Figure 3:
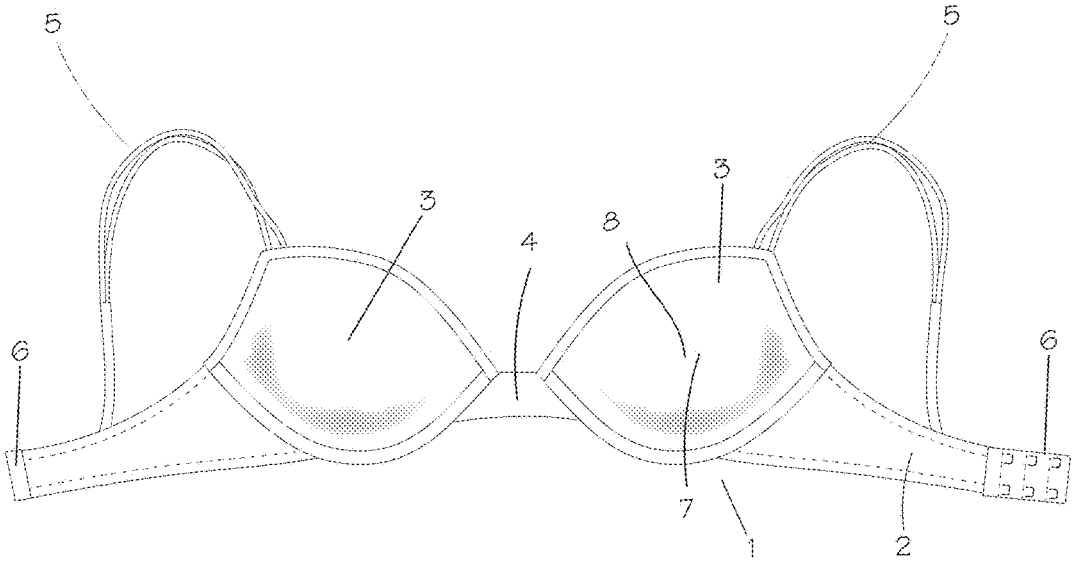
FIG. 3 is a front view of a brassier according to an embodiment of the present invention.
Figure 4:
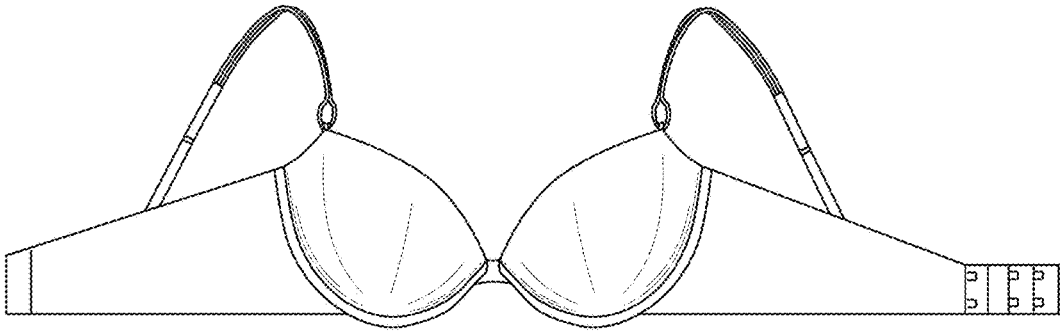
FIG.4 PRIOR ART
FIG. 4 is a front view of a prior art brassiere.
Figure 5:
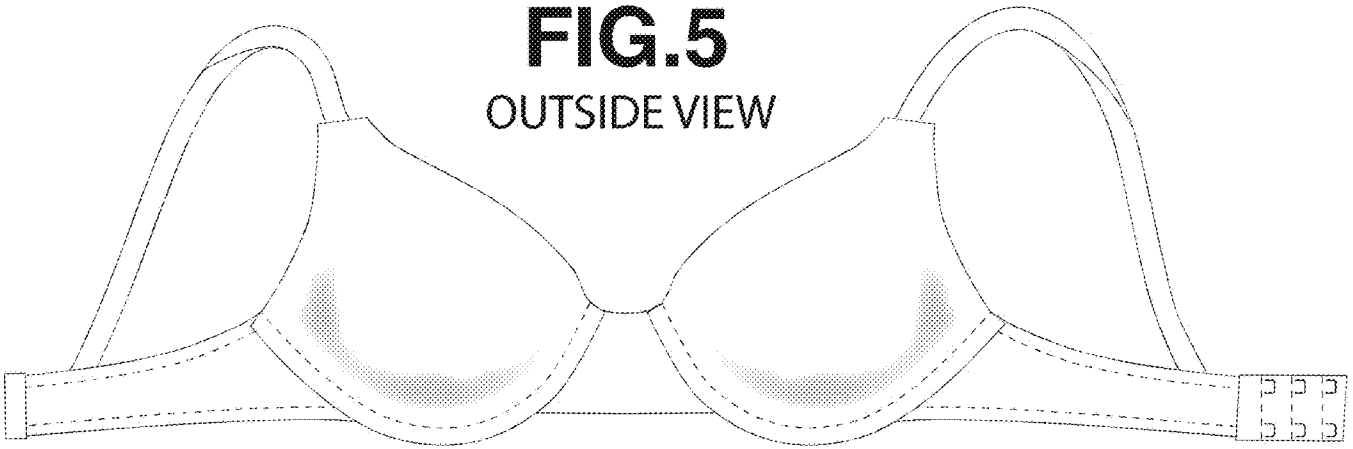
FIG. 5 is a front view of a brassiere according to an embodiment of the present invention, showing an outside view of the brassiere.

As shown in FIG. 3, the brassiere 1 includes first and second wings 2, each wing including a first end and a second end, a closure 6 including a first closure portion on the first end of the first wing, and a second closure portion on the first end of the second wing, a pair of cups 3, a first cup connected to the second end of the first wing, and a second cup connected to the second end of the second wing, a gore 4 connected to each of the first cup and the second cup, between the first cup and the second cup; and a pair of straps 5 including a first strap connected to the first cup and the first wing, and a second strap connected to the second cup and the second wing.

As shown in FIG. 3, each cup 3 includes an inner contour shaped with an inner apex 7 substantially matching a breast to receive the breast in a natural bust point position, and an outer contour having a size larger than the inner contour and shaped with an outer apex 8 spaced medially from the respective inner apex 7, and filling material provided between the inner contour and the outer contour.

Figure 6:
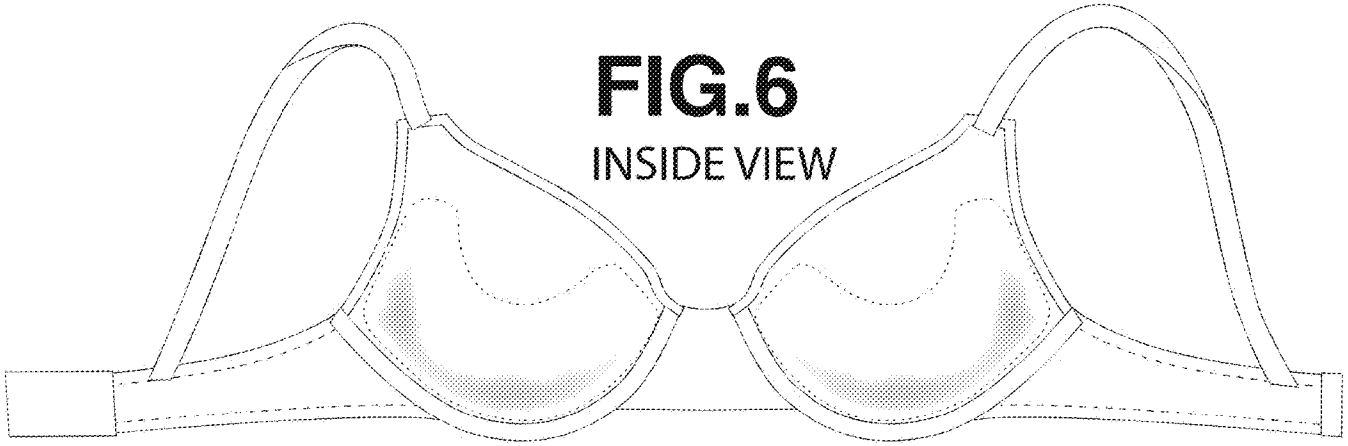
FIG. 6 is a rear view of a brassiere according to the embodiment of FIG. 5, showing an inside view of the brassiere.
Figure 7:
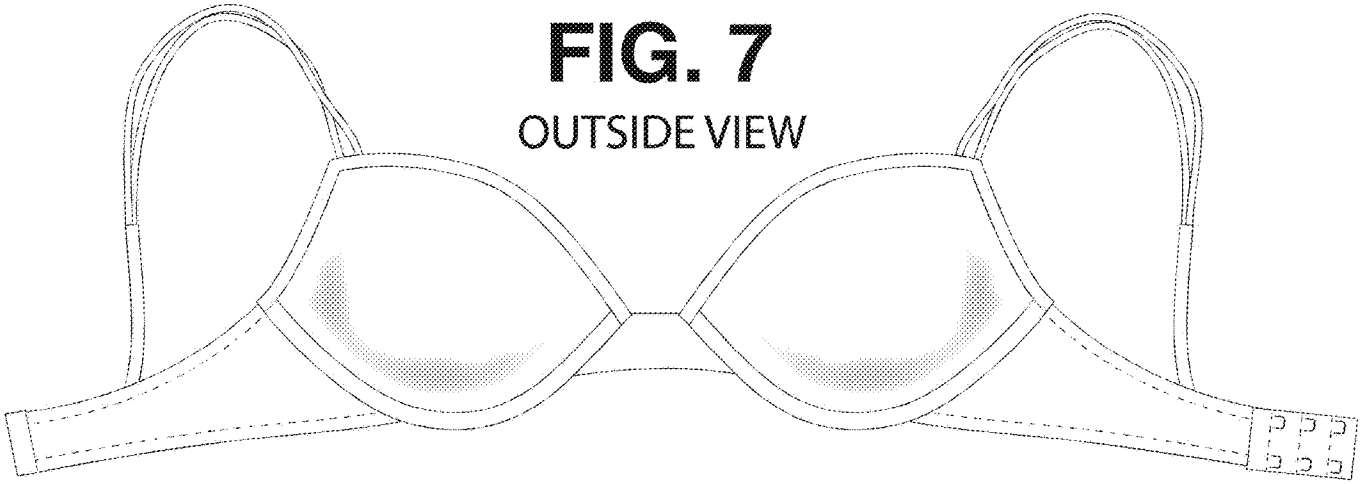
FIG. 7 is a front view of a brassiere according to another embodiment of the present invention, showing an outside view of the brassiere.
Figure 8:
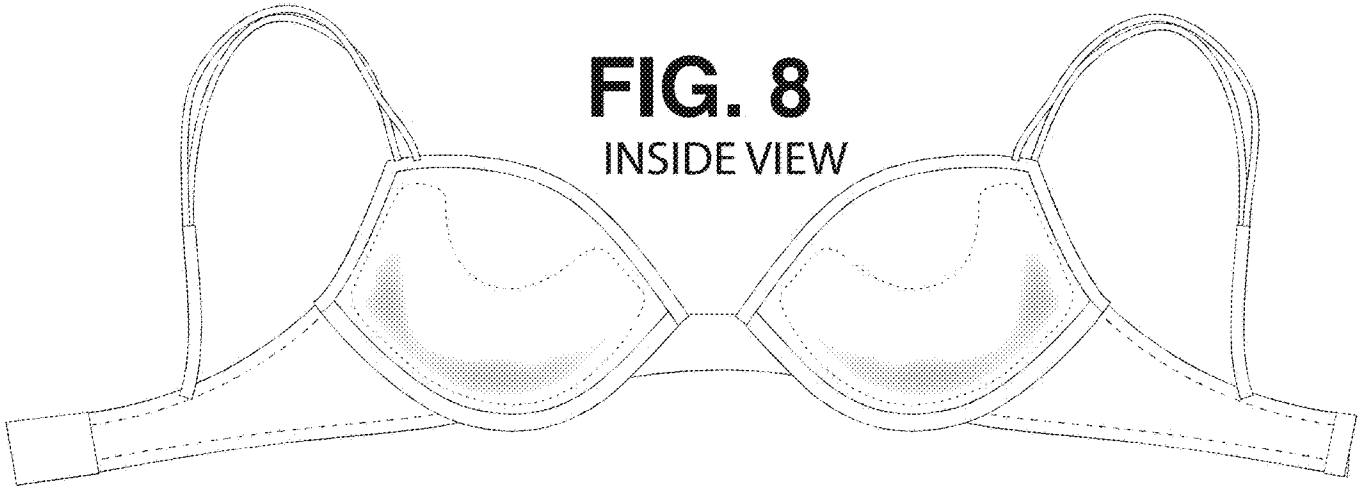
FIG. 8 is rear view of a brassiere according to the embodiment of FIG. 7, showing an inside view of the brassiere.
Figure 9:
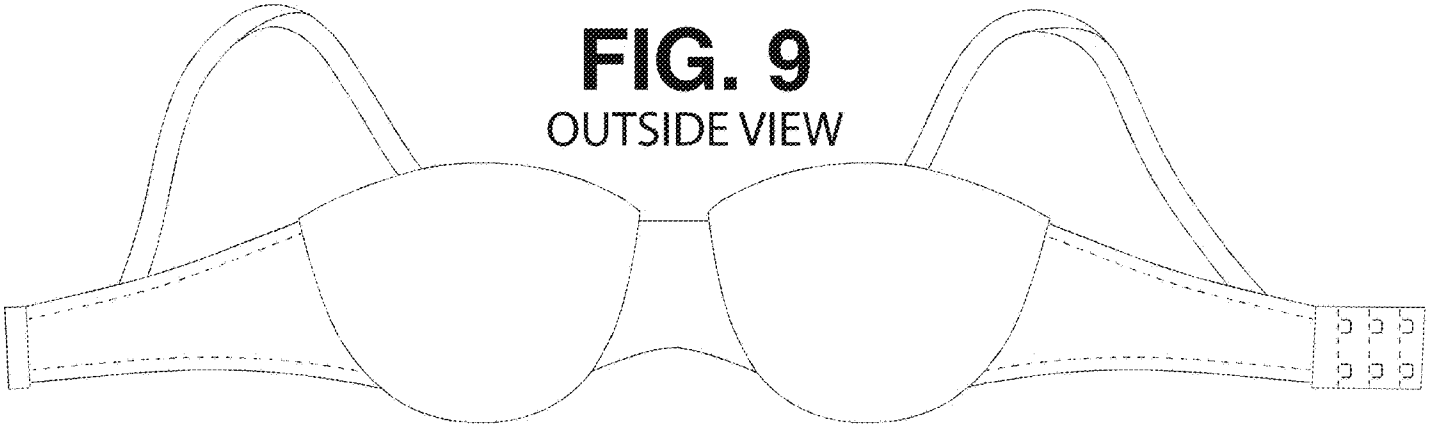
FIG. 9 is a front view of a brassiere according to another embodiment of the present invention, showing an outside view of the brassiere.
Figure 10:
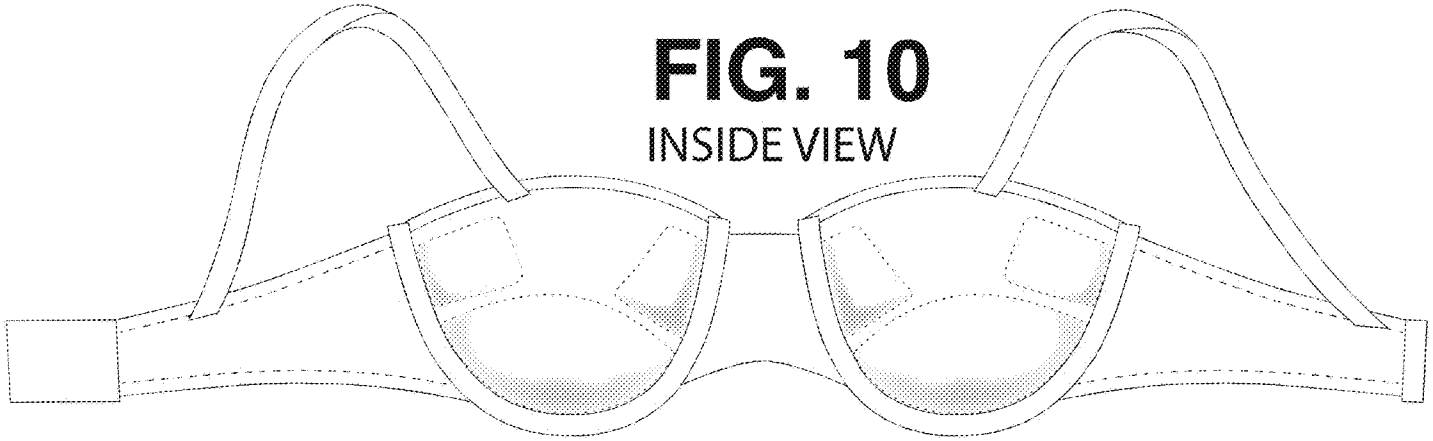
FIG. 10 is a rear view of a brassiere according to the embodiment of FIG. 9, showing an inside view of the brassiere.
Figure 11:
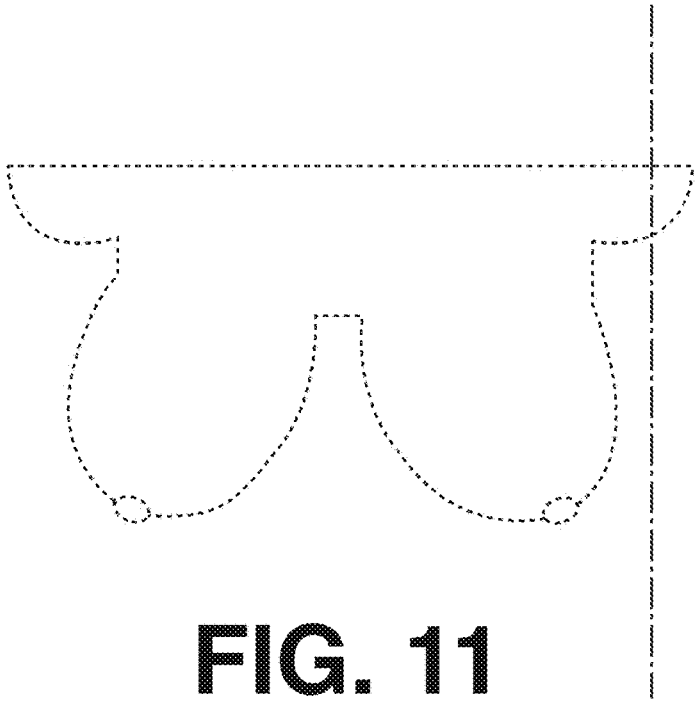
FIG. 11 is schematic diagram of larger size pendulous breasts.
Figure 12:
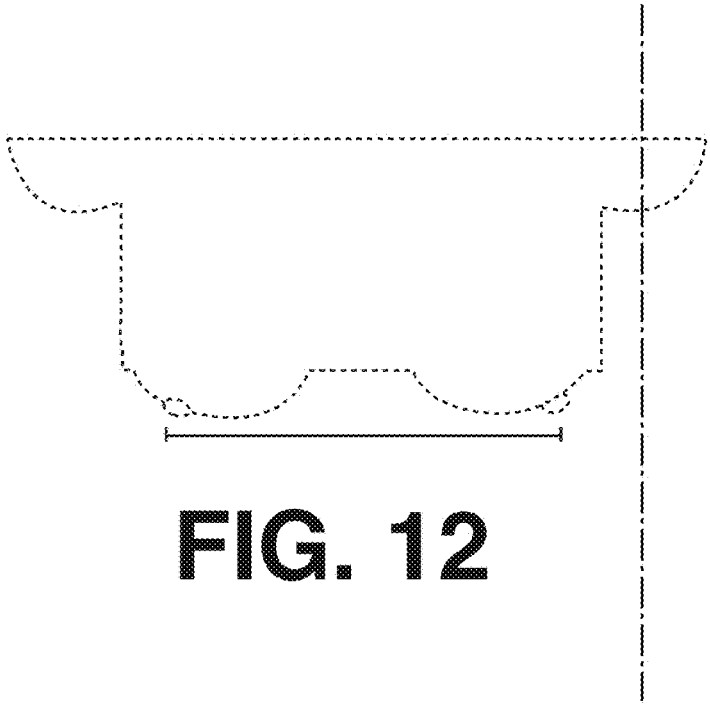
FIG. 12 is a schematic diagram of smaller size breasts, showing a wide breast point spread.

As shown in FIG. 6, each cup 3 may include a pad that extends laterally to the midaxillary line of a brassiere wearer.

Breast tissue extends laterally to the mid-axillary line and medially to the center of the chest. The mid-axillary line is considered the anatomic edge border of the breast. The breast root is the border of the breast. In the brassiere of the invention, the cup extends to the border of the breast (breast root), differing from the present industry sizing for the smaller sizes, which does not extend the cup to the mid-axillary line. Thus, the brassiere of the invention gives a fullness or the illusion of fullness because the cup extends laterally and medially to the natural anatomic border of the breast. Thus, a more natural contour of the smaller breast is acknowledged and accommodated.

On a small-breasted woman, the lateral and medial edge of the breast is not obvious. By scaling from a C cup to a smaller size cup, as is presently done in the industry, the volume is presumed to be less and the boundary is presumed to be smaller. However, this is not true. The brassiere of the invention takes into account that the actual boundaries of the breast root tissue are the same as for a larger breast, but the total breast tissue has a smaller volume.

Smaller sized bras cannot be scaled down from C bras because a pendulous breast projects in a way that a smaller/immovable breast does not. The shape of the breast and the total volume of a larger breast are very different from the shape and total volume of a smaller/immovable breast. Larger breasts and smaller/immovable breasts do not fit into cups in the same manner. Industry assumes they do.

Breast fullness is provided in the widthwise direction, both laterally and medially, and not in a forwardly projecting direction. Breast tissue extends to the outer sides laterally under the armpit. With smaller/immovable breasts, there may not be any breast tissue extending this far in this direction.

The brassiere of the invention contains the breast with the cup extending further laterally, outwardly and inwardly, instead of projecting in the forward direction.

In the brassiere of the invention, the cups are spaced further apart than in the prior art brassieres so that the gore touches the body and the edges of the cups extend to the outer edges of the breasts. The gore must touch the body for the brassiere to operate and function properly.

The diameter of the breast is larger at the breast root than supposed by the industry. In the brassiere of the invention, the cups (or wireless cups) are further apart from each other, and the diameter of the arc of the wire (or cup) is larger than in the current bras.

A C cup is designed for pendulous breasts that are pushed together to be contained. This naturally creates cleavage. The pendulous breasts are also lifted up to support the load. Industry bras are designed to support a load and manage movement, like a bridge. Yet, a small bust does not meet this criteria, and does not need a load supported or movement managed.

The industry scales bras from larger sizes for smaller sizes from bras that are designed to accommodate very different problems than those that actually exist in the smaller/immovable size. In smaller/immovable sizes, there is no load to support, there is no volume to push together comfortably and there is no movement to manage. Industry bras lift breasts that have volume up and together, as there is ample tissue to manipulate. Smaller/immovable sizes do not have tissue to manipulate, yet industry bras for smaller/immovable sizes are graded from larger sizes that are designed to do just that. In fact, it is not possible to move a lesser volume breast in the same way that a larger volume breast can be moved. The center gore (connector) should not be raised off the chest. The gore must contact the chest wall to work functionally.

The brassiere of the invention takes into account that breasts extend laterally and medially. With smaller/immovable breasts, the width must be emphasized to give the illusion of maximum volume and also to keep the smaller/immovable breast in the anatomically correct position. Our focus with the brassiere of the invention is anatomical correctness. Current bras for smaller/immovable sizes do not look right because they are not in the anatomically correct position.

Bringing cups closer together does not work for smaller breasts, and breasts that are immovable. The spacing between cups should be wider which is why we have developed a new system of measurement for the brassiere for the smaller sizes and immovable breasts. We incorporated the spacing between the bust point location and the location of the cups on the band. By spreading out the cups and allowing the gore to sit flat against the chest wall the bra wings and cups are evenly distributed in tension and allow the bra to sit comfortably on the body.

Industry push-up bras push tissue from the sides and move the tissue to the cups. The brassiere of the invention positions the cups on the breasts and fills in the deficits. This enables the cups (underwire, wireless etc.), gore, wings and straps to allow the design to work properly in tension and engineering. The inside bra cups of the brassiere of the invention remain laterally and medially outward where the breast tissue is. The fill fills in the deficits in the cup instead of relying on tissue that doesn't move, or isn't there, in smaller/immovable breasts. We build the breast from out to in by using fill instead of moving the breast.

Pendulous breasts fall down and to the side in their natural state. Industry takes them from the side, brings them to the center and lifts them up. The brassiere of the invention extends the area of the breast root by using a larger diameter for the cup than the standard diameter industry grade. Instead of attempting to move breast tissue toward the center of the body, the brassiere of the invention goes the opposite way. Breast tissue is not pushed forward. The breast tissue is contained and the lateral edge of the breast is redefined to its correct anatomic position.

Fullness in lateral and medial positions provides that the bust is left in its natural position. This is a much more comfortable position than trying to move tissue where it cannot go. Instead of taking what smaller/immovable volume there is and trying to push it forward, we are maximizing its appearance by filling out the breast laterally and medially.

In the brassiere of the invention, we have emphasized the width fullness, and not necessarily front projection fullness. In extending laterally and medially, the tissue deficits are enhanced (built up). We enhance the lateral aspect to provide the natural curve in the natural anatomy of the breast, and not the unnatural forward projection as industry does. We defined the lateral and medial projection, which has not before been discussed or recognized, nor does the prior art recognize its importance. The outside curve provides voluptuousness without projection in the forward direction. The brassiere of the invention thus includes a different way of approaching enhancement. The assumption of the prior art bras is that to make the small breast or breast look as big as possible, cleavage must be increased since cleavage is an indication of volume. However, we are indicating that there are other indications of volume, including the outer lateral curve for lateral fullness. Creating cleavage by pushing the breasts together isn't necessarily the desired goal. To increase the illusion of fullness, outer lateral fullness and medial fullness must first be obtained, and then, if there is enough tissue, cleavage can be provided naturally.

The brassiere of the invention serves breasts that are immovable. Many small breast customers do not have ample tissue to move and manipulate. The brassiere of the invention leaves the breast in its natural position and defines the anterior shape of the cup. We give the smaller/immovable customer a better shape because we extend the width of the breast diameter and we sculpturally place the apex of the cup in the correct proportional place on the outside irrespective of the actual placement of the nipple (apex) inside the cup.

The brassiere of the invention contains the breast in a contoured cup and does not attempt to move the breast tissue. This is an improvement over the prior art brassieres that attempt to move tissue that isn't there or attempt to move tissue that does not move. In particular, the smaller/immovable breast is not pendulous and does not include enough weight that will hang down and out to the sides. The smaller/immovable size breast does not act and react in the same ways as the larger breast. Our cup is a smaller cup size on the inside (i.e. A cup) and a larger size cup on the outside (i.e. B cup). The invention provides a bra that is anatomically correct.

The brassiere of the invention includes pads that extend laterally and medially to the sides. The brassiere of the invention also includes pads on the upper portion of the cup that extend higher than in the prior art to fill in the deficits of the smaller/immovable breast.

The brassiere of the invention is a bra cup designed specifically for the smaller/immovable bust with an average cup size traditionally called AAA, AA, A, and B. The brassiere was designed in response to the absence of correct fitting and correct looking bras for the smaller/immovable sizes. Industry traditionally produces A cups scaled down from a C cup size. The C cup is considered an average in which to scale up or down from, based on a full range of sizes. However, we have determined that is ineffective to scale off of a C cup for an A cup. Larger sized bras are designed and engineered to carry busts with weight, volume, and mass. An A cup does not have weight, mass or volume, yet the cup is still scaled down from a cup that was created and engineered to support these factors. Cup sizes C and larger have some degree, or a large degree of mass, weight and volume. They can be moved and manipulated to be positioned into the cups.

Industry designs these bras to contain the weight and engineer the product to work with this weight and movement. An A size bust has none of these features. An A size bust is 1" larger than the rib cage and cannot be manipulated the way the larger sizes can. An A cup breast also does not need the same support as the larger sizes, yet the cups produced are scaled down from a mass and weight bearing philosophy.

The engineering for a brassiere for larger bust design does not scale properly for the smaller/immovable bust. The brassiere of the invention for an A cup was designed specifically for the small/immovable bust. One of the problems with a small bust is that there is no real volume so the bust points are relatively fixed.

The sizing for the bra is based on bust point measurements. Size A1 is based on a bust point spread of 5"-6½". Size A2 is based on a bust point spread of 6½"-8". The bands are measured as standard sizing, i.e., 30", 32", 34", 36".

The sizing of the present invention is based on proportion. The cups are made up of an inside criteria and an outside criteria. Each criteria has a separate function.

Our outside AA cup has an inside accommodation for a AAA volume and is called AAA.

Our outside A cup has an inside accommodation for a AA volume and is called AA.

Our outside B cup has an inside accommodation for an A volume and is called A.

Our outside C cup has an inside accommodation for a B volume and is called B.

Our outside AA double fill cup has an inside accommodation for a AAA volume and is called AAA/A.

Our outside A double fill cup has an inside accommodation for a AA volume and is called AA/B.

Our outside B double fill cup has an inside accommodation for an A volume and is called A/C.

Our outside C double fill cup has an inside accommodation for a B volume and is called B/D.

As shown in FIGS. 1, 3, 4, 6, and 7, the cup spacing, or gore, is different from that in the prior art. Our cups are spaced wider apart than industry standard to accommodate immovable tissue. This allows the cups to be properly positioned on the breasts. It also allows the gore to sit flat on the chest wall and allow the engineering of the bra to work properly. Our sizing recognizes the differences in bust point location and is called 1, 2, and 3.

The sizes are listed below:

| For band width: 26, 28, 30, 32" |
|---|
| Size 1: BUST POINT SPREAD 5"-6"<br>Size 2: BUST POINT SPREAD 6"-7"<br>Size 3: BUST POINT SPREAD 7"-8" |

| For band width: 34" |
|---|
| Size 1: BUST POINT SPREAD 5"-6½"<br>Size 2: BUST POINT SPREAD 6½"-8" |

| For band width: 36, 38" |
|---|
| Size 1: BUST POINT SPREAD 5"-6½"<br>Size 2: BUST POINT SPREAD 6½"-8" |

The AA (AA inside/A outside) measures inside volume (<1") highpoint projected from chest wall with inside fill to compensate for outside radius cup equivalent to industry (A) breast root measurement underwire and our sculpted outside cup. The AA/B (AA inside/B outside) measures inside volume (<1") highpoint projected from chest wall with inside fill to compensate for outside radius cup equivalent to industry (B) breast root measurement underwire, and inside fill equivalent to midway between an (A) and a (B) projected from chest wall and midway between an (A) and a (B) sculpted outside cup.

The A (A inside/B outside) measures inside volume (1") highpoint projected from chest wall with inside fill to compensate for outside radius cup equivalent to industry (B) breast root measurement underwire and our sculpted outside. The A/C (A inside/C outside) measures inside volume (1") highpoint projected from chest wall with inside fill to compensate for outside radius cup equivalent to industry (C) breast root measurement underwire, and inside fill equivalent to midway between a (B) and a (C) projected from chest wall and midway between a (B) and a (C) sculpted outside cup.

The B (B inside/C outside) measures inside volume (2") highpoint projected from chest wall with inside fill to compensate for outside radius cup equivalent to industry (C) breast root measurement underwire and our sculpted outside. The B/D (B inside/D outside) measures inside volume (2") highpoint projected from chest wall with inside fill to compensate for outside radius cup equivalent to industry (D) breast root measurement underwire, and inside fill equivalent to midway between a (C) and a (D) projected from chest wall and midway between a (C) and a (D) sculpted outside cup.

The industry assigns the (C) projection as 3" from the chest wall and (B) projection as 2" from the chest wall, the double fill A/C is about 2½"-2¾" projected from the chest wall as the projection of the fill is spread wider than industry.

The AA/B double fill cup projects about 1½"-1¾" from the chest wall. The A/C double fill cup projects about 2½"-2¾" from the chest wall. The B/D double fill cup projects about 3½"-3¾" from the chest wall.

Sizing May be, but not Limited to:

| 32AA1 | 32AA2 | 32AA3 | 32AA/B1 | 32AA/B2 | 32AA/B3 |
|---|---|---|---|---|---|
| 34AA1 | 34AA2 | | 34AA/B1 | 34AA/B2 | |
| 36AA1 | 36AA2 | | 36AA/B1 | 36AA/B2 | |
| 38AA1 | 38AA2 | | 38AA/B1 | 38AA/B2 | |
| 32A1 | 32A2 | 32A3 | 32A/C1 | 32A/C2 | 32/C3 |
| 34A1 | 34A2 | | 34A/C1 | 34A/C2 | |
| 36A1 | 36A2 | | 36A/C1 | 36A/C2 | |
| 38A1 | 38A2 | | 38A/C1 | 38A/C2 | |
| 32B1 | 32B2 | 32B3 | 32B/D1 | 32B/D2 | 32B/D3 |
| 34B1 | 34B2 | | 34B/D1 | 34B/D2 | |
| 36B1 | 36B2 | | 36B/D1 | 36B/D2 | |
| 38B1 | 38B2 | | 38B/D1 | 38B/D2 | |

For example, 32 is the ribcage measurement, measured according to industry. AA is the breast tissue volume of (<1") according to industry calculation. 1 is the location of the bust point spacing. The grade of the outside cup will be based on the anatomical correct proportion of the breast based on the ribcage measurement. The grade of the inside cup will be based on the amount of breast tissue volume and the amount of fill required to support the outside cup grade.

The cups of the brassiere of the invention were also designed to fill in the hollows and create the appearance of a fuller, wider heavier bust. The cups are a hybrid. That is, the cups are comprised of a B sized and sculpted outer cup with an A sized and sculpted inner cup. The inside is sculpted and created to fill in the areas that the A bust is missing due to its limited mass and weight and to hold up and fill out the larger outer shell of the cup.

Figure 13:
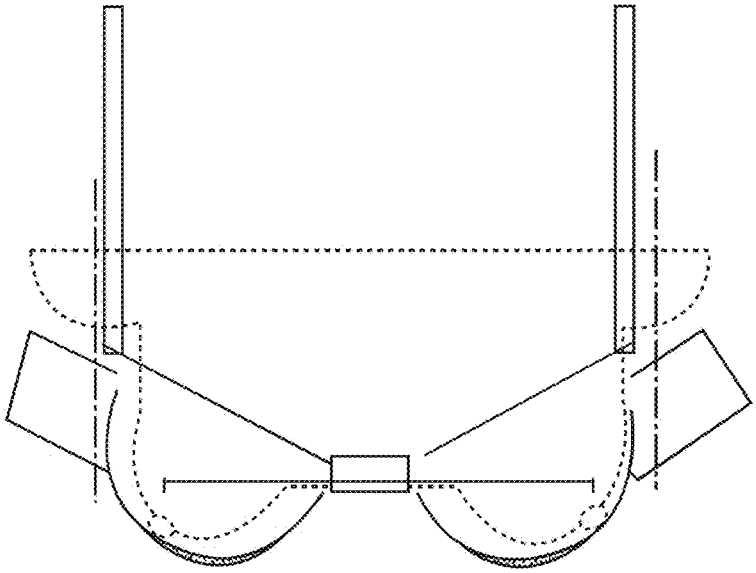
FIG. 13 is an schematic diagram of the brassiere of the invention showing the outside cup shape, and the location of the cup outer apex spaced medially from the inner cup apex and the breast point.
Figure 14:
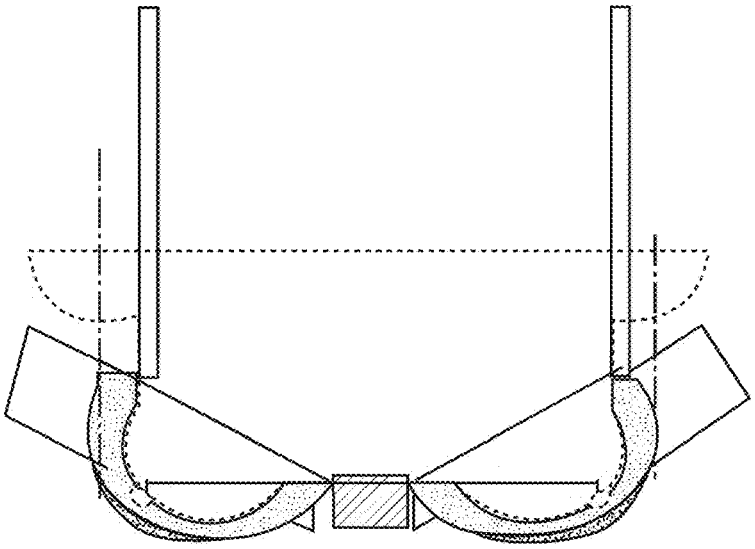
FIG. 14 is a schematic diagram of the brassiere of the invention showing the inside cup shape, and the location of the cup outer apex spaced medially from the inner cup apex and the breast point.
Figure 15:
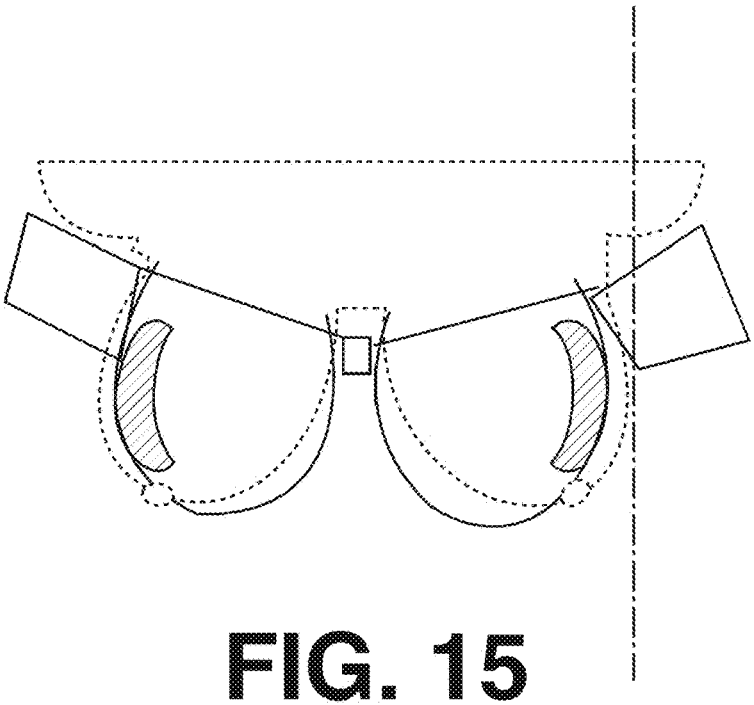
FIG. 15 PRIOR ART
FIG. 15 is a schematic diagram of larger size pendulous breasts in a natural position and showing a superimposed brassiere.
Figure 16:
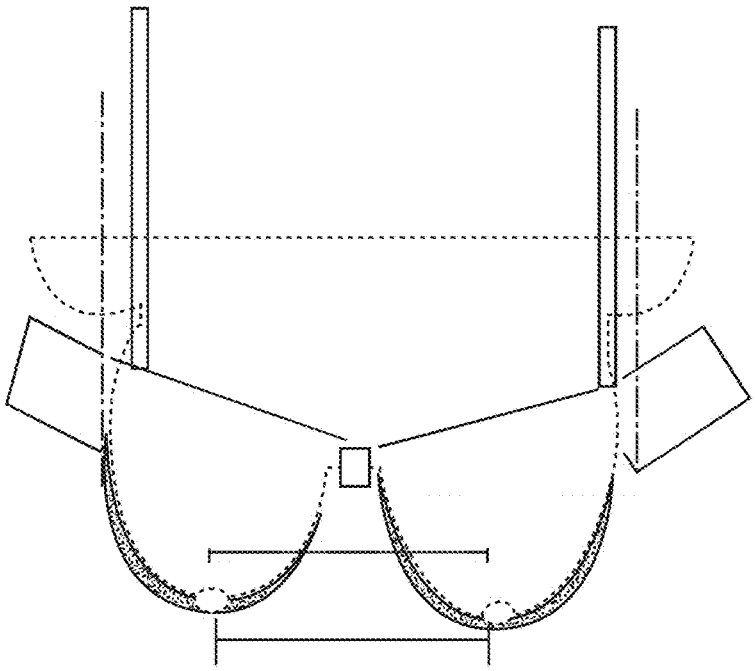
FIG. 16 PRIOR ART
FIG. 16 is a schematic diagram of larger size pendulous breasts contained in a brassiere, showing that the breast points have been moved toward each other for the breast to be contained in the brassiere.
Figure 17:
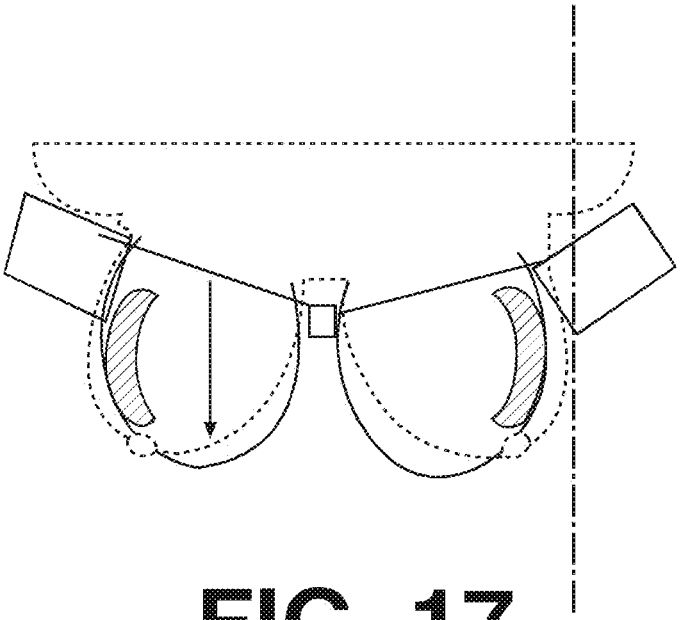
FIG. 17 PRIOR ART
FIG. 17 is a schematic diagram of larger size pendulous breasts in a natural position and showing a superimposed brassiere, showing the location of the cup apex spaced medially from the location of natural position of the breast points.
Figure 18:
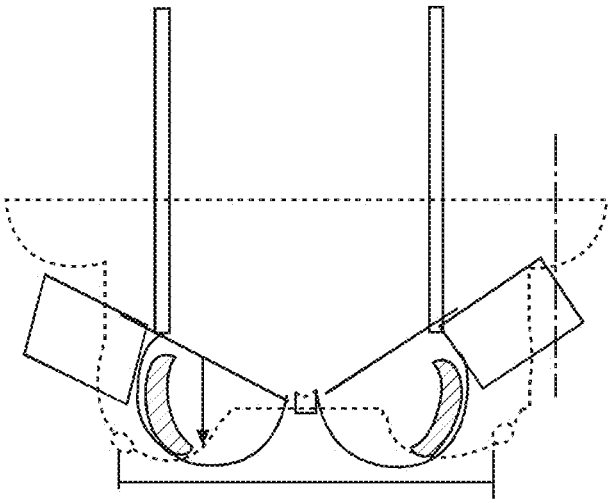
FIG. 18 PRIOR ART
FIG. 18 is a schematic diagram of smaller size breasts and showing a superimposed incorrectly fitting industry graded brassiere scaled from C to A, and showing of the cup apex spaced medially from the location of the natural position of the breasts.
Figure 19:
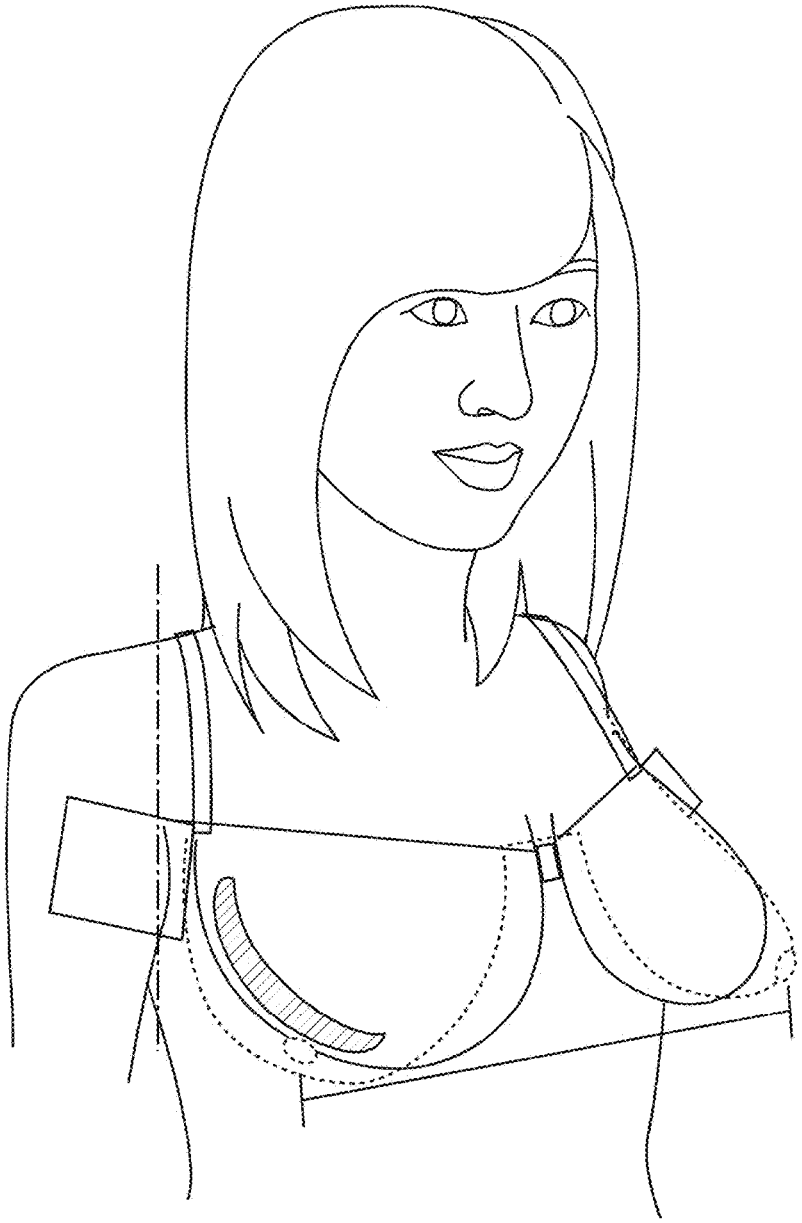
FIG. 19 PRIOR ART
FIG. 19 is a schematic diagram of larger size pendulous breasts in a natural position and showing a superimposed brassiere, showing the bust point spread of the natural position.

The outside of the cup is sculpted to have a simulated look of a weighted bust and the apex of the bust is placed in a proper position separate and apart from the at rest position of the areola positioned in the inside cup A. For example, the natural bust point spread of an A bust might be 7-8". We designed the inside cup to be placed on the bust in its natural resting position inside and we designed the outside B cup to have the most desired B cup shape irrespective of the inside sitting position and bust point spread. In other words, we created the outside look first, and then built the inside to properly accommodate the bust, and vice versa. See particularly FIGS. 13 and 14.

Calculating Cup Volume and Breast Weight:

The average breast weighs about 0.5 kg (1.1 lb). Each breast contributes to about 4%-5% of the body fat.

The density of fatty tissue is more or less equal to 0.9 kg/1 for all women. The volume of a woman's individual breasts can vary. Bra designers can give it the shape of a hemisphere or a hemi-spheroid by fitting it into a cup. If the bust is considered essentially a half sphere, its volume V is determined by the following formula:

$$V=2\pi r^3/3\,V=2.1\times r^3\,V=0.26\times D^3$$

Where D is the diameter of the sphere and r is the radius of the sphere.

If the breast is shaped more like a spheroid, the designer might use the formula like the following:

$$V=0.26\times D^2/b\times h$$

Where b equals diameter of the hemispheroid's base and h equals the height of the spheroid.

Other formulas can be derived as needed to design bras for differently shaped breasts. All of these formulas assume that the breasts conform to the mentioned mathematical model.

Cups give a hemispherical shape to the breast, and underwires give shape to the cups. So the curvature radius of the underwire is key to determine volume and weight of the breast. The same underwires are used for the cups of sizes 36A, 34B, 32C, 30D, and etc., so these cups have the same volume. The reference numbers of underwire sizes are based on a B cup bra, for example, underwire size 32 is for 32B cup (and 34A, 30C, . . . ). An underwire size 30 width has a curvature diameter of 3⅝=9.7 cm and this diameter increases by ⅓ in=0.847 cm by size. The table below shows volume calculations for some cups that can be found in ready to wear large size shop.

| Underwire size | Bra size (US system) | Cup Diameter | Volume of one cup | Weight |
|---|---|---|---|---|
| 30 | 32A, 30B, 28C | 9.7 cm (3⅝ in) | 240 cc (0.51 US pt) | 0.43 kg |
| 32 | 34A, 32B, 30C, 28D | 10.6 cm (4⅛ in) | 310 cc (0.66 US pt) | 0.56 kg |
| 34 | 36A, 34B, 32C, 30D | 11.4 cm (4½ in) | 390 cc (0.82 US pt | 0.70 kg |
| 36 | 38A, 36B, 34C, 32D | 12.3 cm (4⅝ in) | 480 cc (1.0 US pt) | 0.86 kg |

By using the above chart based on the volume of a 34A cup (310 cc) and a 34B cup (390 cc) we are filling the invention with the equivalent of about 80 cc of foam which is the difference between the volume of a standard industry A cup and a standard industry B cup.

The cup diameter we are using is equivalent to a 34B (11.4 cm=4½ in) according to the above chart for our 34A bra which according to the above chart industry uses 10.6 cm (4⅛ in).

We are using dimensions of a 34B cup for our A bras and filling in the deficits in circumference and volume (lack of B volume) with foam. The foam is built up on the inside to fill in the breast tissue deficit, and sculpted on the outside to make the cup look like it has the weight and volume of a B cup. We put the exterior bust point location on the center line of what would have been a 34B cup and we made the appearance of weight in the cup look like it is a 34B. We made what normally would be a 34B cup into an A cup using a B wire so there is more width in the wire on the body. The location that the wire sits on the body is integral to a correct fit.

Industry bras shape the breast and manipulate tissue.

Our invention does not use the breast inside to affect the shape on the outside.

From the website Beauty Lies Beneath, under the heading "Finding your bra size":

| Difference | Standard Cup Size |
|---|---|
| 0"-½" (1.3 cm) | AA |
| ½"-1" (2.6 cm) | A |
| 1"-2" (5.1 cm) | B |
| 2"-3" (7.6 cm) | C |

According to this chart, we use the difference between an A cup (2.6 cm) and a B cup (5.1 cm) to fill the inside of the B cup measurements we are using for our A cup.

The brassiere of the invention was also designed to fill in the space between the two bust points that is empty. To accomplish that, the cups, and cup diameter (underwire and wireless) are made wider than the actual A cup bust and in some styles the fabric was stretched between the cups to give the illusion of volume where there isn't any. Another point that was addressed was creating an illusion of a fuller shape of the breast using creative definition with stitching.

The goal of the brassiere of the invention is to maximize the look of the existing bust using fill inside around the side, and larger wider sized cups outside, to create a comfortable and well-fitting bra for the small size by creating a counter force between the bust, the cups, and the wings using foam to counter balance the cups and give the illusion of weight and mass. Special tension engineering was used to make the bra fit comfortably without pressing the bust to the pads or the body. And to give the A cup customer a wide range of designs accommodating the unique problems of a small bust i.e., bust point spread and breasts that cannot be moved and positioned like larger breasts.

The brassiere of the invention also has a line of swim and exercise bras taking these same needs into account.

Due to a lack of weight in the smaller size breast we created a counterforce between the pad and the frame to simulate the feeling of a contained breast. The cup was designed to compensate for the missing mass of the breast. To do this we created a compensatory cup inside which we call variations of an A cup and sculpted a wider form similar to the B cup on the outside to include the look and feel of a weighted bust. The gravity of the A cup bust is absent, yet industry bras are designed to contain and support a weighted mass. Our bras work in the exact opposite of industry. We created the force in our pads to keep the bra close to the body as opposed to industry design using the body (bust) to counterforce the bra. Our engineering for the A bra takes something that is basically weightless and creates a counterforce by designing the foam in the inner form to expand the width and circumference of the bust. Industry bras are engineered for gravitational interaction yet for the A customer this gravity does not apply for the limited weight and mass. Scaling down from a C cup (which industry does) does not properly serve the A cup breast, which is very small and is neither pliable nor weighted.

The exercise Zero G Hybrid bra a/B A/B b/B b/C is a breast shaper for the small bust. It is made to create the look and feel of weight and mass of a B cup sized bust by combining an inner A cup and a uniquely sculpted outer cup B. The arc and bust point location on the outer cup was designed to simulate the weight and mass of a B cup bust. The A cup on the inside was designed to accommodate the actual A cup bust keeping it in its natural position and filling in the hollow spaces while allowing proper positioning of the placement of the aureole irrespective of the visual location of the arc and bust point location on the B cup exterior. Thus, the hybrid brassiere of the invention is a combination of two cup sizes. The inner cup contains the A cup bust, and the outer cup is sculpted and sized to a B cup (as an example for that size).

The solution of the present brassiere is illustrated by the European sizing calculators and conversion charts. The solution or the present brassiere and sizing includes measurements that don't require calculations. Calculations can up with the wrong measurement. There are no calculations: 34" band; and 1" breast projection equals 34A. There are no conversion of sizes, no subtracting as in the industry. In the present brassiere and sizing, measure the breasts around the breast (bust), and measure the rib cage under the bust. If the difference is 1", the size is an (A). Thus, a very simple determination of the size for a particular wearer.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

What is claimed is:

1. A brassiere configured for users with non-pendulous breasts and which is adapted to retain the non-pendulous breasts in an anatomically correct position without pushing breast tissue together, comprising:

a first wing having a first end and a second end;

a second wing having a first end and a second end;

a first closure portion arranged on the first end of the first wing;

a second closure portion provided on the first end of the second wing;

a first cup sized and configured for a non-pendulous breast having a cup size of AAA, AA, A or B, said first cup having an outer portion connected to the second end of the first wing;

a second cup sized and configured for a non-pendulous breast having a cup size of AAA, AA, A or B, said second cup having an outer portion connected to the second end of the second wing;

a gore comprising a first end connected to an inner portion of the first cup and a second end connected to an inner portion of the second cup, said gore being sized and configured to contact and sit flat on a chest wall and defining a cup spacing between the first and second cups;

each of said first cup and said second cup comprising:

an inner contour defining a cup volume and having a perimeter diameter;

an outer contour defining a volume larger than the cup volume and having a cup diameter that is larger than the perimeter diameter; and a fill material disposed between the inner contour and the outer contour, wherein one of:

when the brassiere has a band size of 26 inches, 28 inches, 30 inches or 32 inches, the cup spacing accommodates a bust point spread that is between one of 5 to 6 inches, 6 to 7 inches, or 7 to 8 inches; or when the brassiere has a band size of 34 inches, 36 inches, or 38 inches, the cup spacing accommodates a bust point spread of between 5 to 6.5 inches or between 6.5 to 8 inches, and wherein the inner contour has an inner apex and the outer contour has an outer apex that is medially offset from the inner apex.

2. The brassiere of claim 1, wherein one of:

when the inner contour is an AA cup size, the outer contour has an A cup size outer radius;

when the inner contour is an AA cup size, the outer contour has a B cup size outer radius;

when the inner contour is an A cup size, the outer contour has a B cup size outer radius;

when the inner contour is an A cup size, the outer contour is a C cup size outer radius;

when the inner contour is an B cup size, the outer contour is a C cup size outer radius; or when the inner contour is a B cup size, the outer contour is a D cup size outer radius.

3. The brassiere of claim 1, wherein the outer contour is a different cup size than a C or a D cup size.

4. The brassiere of claim 1, wherein the cup volume is 310 cc and the cup diameter is 4.5 inches.

5. The brassiere of claim 1, wherein the cup volume is 390 cc and the cup diameter is 4 and 5/6 inches.

6. The brassiere of claim 1, wherein when the brassiere has a bra size of 34A, 32B, or 30C or 28D, the cup diameter is 4.5 inches.

7. The brassiere of claim 1, further comprising:

a first strap having a first end connected to an upper portion of the first cup;

a second strap having a first end connected to an upper portion of the second cup; and the gore having greater length than width.

8. The brassiere of claim 1, wherein the inner contour is an AAA cup size.

9. The brassiere of claim 1, wherein the inner contour is an AA cup size.

10. The brassiere of claim 1, wherein the inner contour is an A cup size.

11. The brassiere of claim 1, wherein the inner contour is a B cup size.

12. The brassiere of claim 1, wherein the first and second cups have a curved lower edge that is located below a lower end of the gore.

13. The brassiere of claim 1, wherein the first and second cups have a curved lower edge that is located below a lower end of the first and second wings.

* * * * *